US005720816A

United States Patent [19]

Li et al.

[11] Patent Number: 5,720,816

[45] Date of Patent: Feb. 24, 1998

[54] REVERSE FEED FILM APPLICATOR

[75] Inventors: Alfred C. Li, Naperville, Ill.; Rex A. Becker, Janesville, Wis.; James R. Burns, Augusta, Me.

[73] Assignee: Beloit Technologies, Inc., Wilmington, Del.

[21] Appl. No.: 611,337

[22] Filed: Mar. 8, 1996

[51] Int. Cl.[6] ..... B05C 3/02

[52] U.S. Cl. ..... 118/410; 118/411; 118/413; 118/419; 427/356

[58] Field of Search ..... 118/410, 411, 118/413, 419; 427/356

[56] References Cited

U.S. PATENT DOCUMENTS

| | | | |
|---|---|---|---|
| 4,357,370 | 11/1982 | Alheid | 427/211 |
| 4,761,309 | 8/1988 | Embry | 427/294 |
| 4,834,018 | 5/1989 | Sollinger et al. | 118/410 |
| 4,839,201 | 6/1989 | Rantanen et al. | 427/355 |
| 4,860,686 | 8/1989 | Kato et al. | 118/410 |
| 4,903,632 | 2/1990 | Sollinger | 118/123 |
| 4,945,855 | 8/1990 | Eklund et al. | 118/410 |
| 4,961,968 | 10/1990 | Shands et al. | 427/356 |
| 5,183,691 | 2/1993 | Hassel et al. | 427/286 |
| 5,192,591 | 3/1993 | Chance | 118/413 |
| 5,199,991 | 4/1993 | Chance | 118/410 |

FOREIGN PATENT DOCUMENTS

| | | |
|---|---|---|
| 0436172 | 10/1991 | European Pat. Off. . |
| WO 96 36767 A | 11/1996 | WIPO . |

OTHER PUBLICATIONS

"BA 1500™ Coater: Versatile, high speed blade applicator produces quality coated papers," a brochure by Rader Companies, a division of Beloit Corporation. (No Date).

"New Coating Technologies Combine High Speeds With Higher Quality," an article published in *Pulp & Paper*, by Andy Harrison, pp. 60–64. May 1994.

"*Optiblade™— a new method for high-speed LWC coating,*" article by Jukka Linnonmaa and Martti Tyrväinen, 3 pages, *PaperNews*, published by Valmet Corporation, Helsinki, Finland.

*Primary Examiner*—Laura Edwards
*Assistant Examiner*—Michael P. Colaianni
*Attorney, Agent, or Firm*—Dirk J. Veneman; Raymond W. Campbell; Gerald A. Mathews

[57] ABSTRACT

An applicator head is positioned beneath a backing roll over which a substrate can be drawn. The applicator head has a housing which contains a pond of coating material between an up machine overflow lip and a down machine extraction plate or premetering plate. Coating material at a relatively low velocity flows into the pond adjacent to the overflow lip. The premetering plate extends radially from the coating inlet to a position proximate to and converging with the backing roll, where it premeters the amount of coating applied to the substrate. The premetering plate preferably has a plurality of holes through which coating and air are drawn. A metering element is spaced downstream of the premetering plate, and a low pressure area is constructed therebetween. Air and coating are drawn from the low pressure area through a valve, and the pressure thereby controlled.

14 Claims, 3 Drawing Sheets

78
24
48
32
30
42
26
23
20
22
36

REVERSE FEED FILM APPLICATOR

FIELD OF THE INVENTION

The, present invention relates to an apparatus for coating a substrate in general and to a short dwell coater apparatus in particular.

BACKGROUND OF THE INVENTION

Paper is formed of a mat of fibers, typically cellulose fibers from wood, produced by draining fibers from stock in a papermaking machine. The fibers making up a sheet of paper influence the paper's surface finish or texture. The surface attributes of the paper may be modified by calendering or chemically treating the paper. However, for many applications, such as for the paper employed in magazines and printed advertising in flyers, a desirable glossy high brightness finish can best be achieved by coating the paper.

The coating material is typically comprised of a mixture of clay or fine particulate calcium carbonate which provides a flat filled surface, titanium dioxide for white coloring, and a binder. Coated papers come in a number of weights and grades depending on the weight of the paper and the thickness of the coating.

One type of coater, called a flooded nip coater, is particularly suitable for heavier grades of coated paper, and employs a roll partly submerged in a bath of coating. The roll transfers a film of coating to one side of the paper web. The coated web is wrapped around a backing roll which forms a nip with the coating roll. Following contact with the coating roll the web passes around the backing roll to a metering blade which contacts the applied coating and controls the overall thickness of the coating.

For lightweight paper grades, which may be run at higher machine speeds, the short dwell coater has been developed. The short dwell coater maintains a pond of coating which is held against a backing roll. A paper web is directed about the backing roll through the pond. The web's short dwell time in the pond of coating results in a relatively thin layer of coating on the web.

An improved coater known as the BA 1500 coater by Beloit Corporation employs a combination of a short dwell coater with a wiping blade similar to the flooded nip coater and has proven practical at a wide range of paper weights and paper speeds.

Short dwell coaters are advantageously used for coating fluids on lightweight and other grades of paper. The short dwell coater employs a pond of coating material. The pond is formed in a feed cavity and fed with an excess of coating material. The pond is caused to overflow in the up machine direction thereby flooding the web and pre-wetting it as it approaches the pond. On the downstream side, a metering blade controls the amount of coating material which is applied to the moving web. The coating material is fed into the pond and against the moving web at relatively low velocity. However, upon contact with the web, the coating material becomes entrained in a boundary layer attached to the web which is moving at a velocity of 75 to 100 feet per second or more. The high velocity boundary layer impinges on the doctoring blade and is turned downwardly into the pond creating a recirculating zone between the down machine end of the pond and the coating feed at the up machine end of the pond where the excess coating overflows. The paper web as it enters the pond and is wetted by the pond pulls along a boundary layer of air which penetrates some distance into the pond as the web moves through the pond.

The location where the paper becomes wetted by the coating material is defined as the dynamic contact line. As the speed of the machine increases beyond forty-five hundred feet per minute, the fluid flow in the pond tends to destabilize. A result of destabilized flow is that the dynamic contact line oscillates both in the machine direction and in the cross-machine direction. Further, air from the boundary layer is entrained at the oscillating dynamic contact line and is eventually entrapped in the vortex formed by the recirculating fluid flow within the pond. The vortex periodically becomes overcharged with air and expels coating out of the pond. These two phenomena, the destabilization of the flows and the accumulation of air in the vortex within the pond results in coating defects which can manifest themselves as streaks on the coated paper. At the same time that increasing the paper web speed in a papermaking machine can have deleterious effects on coating quality, increased machine speed is essential to increased productivity and reduced costs. A papermaking machine is a very substantial capital investment which must be amortized over the quantity of paper manufactured thereon. Therefore, increasing the machine speed is critical to continued increase in papermaking productivity.

What is needed is a film applicator capable of functioning at higher speeds without inducing defects in the paper produced.

SUMMARY OF THE INVENTION

The film applicator of this invention employs a backing roll over which substrate is drawn. An applicator head is positioned below the backing roller and forms a pond of coating material between an up machine overflow lip and a down machine metering element. Coating material at a relatively low velocity flows into the pond adjacent to the overflow lip. Whereas in a conventional short dwell coater, the down machine edge of the pond is terminated by a metering element or blade, in the applicator of this invention, an extraction plate is disposed between the pond and the metering element. The plate extends from the coating inlet to a position proximate to and converging with the backing roll, where it premeters the amount of coating applied to the substrate. The extraction or premetering plate is spaced from the metering element and a low pressure area is constructed therebetween. The extraction plate preferably has perforations and works to remove a large portion of air and excess coating away from the substrate preventing instabilities from propagating to the metering element. The extraction plate minimizes the mixing problem between the feed and recirculating coating in the pond, thus reducing the macroscopic scale flow variations. It is these flow variations adjacent to the metering element which are strongly suspected as the root cause of the streaking or incomplete coating of a substrate.

It is a feature of the present invention to provide a film applicator which may operate at higher machine speeds.

It is another feature of the present invention to provide a film applicator which applies a more uniform coating to a substrate.

It is a yet further feature of the present invention to provide a film applicator wherein entrained air within the pond is removed.

It is a still further feature of the present invention to provide a film applicator wherein flow instabilities are prevented from propagating to the applicator metering element.

Further objects, features and advantages of the invention will be apparent from the following detailed description when taken in conjunction with the accompanying drawings.

DESCRIPTION OF THE PREFERRED EMBODIMENTS

Figure 1:
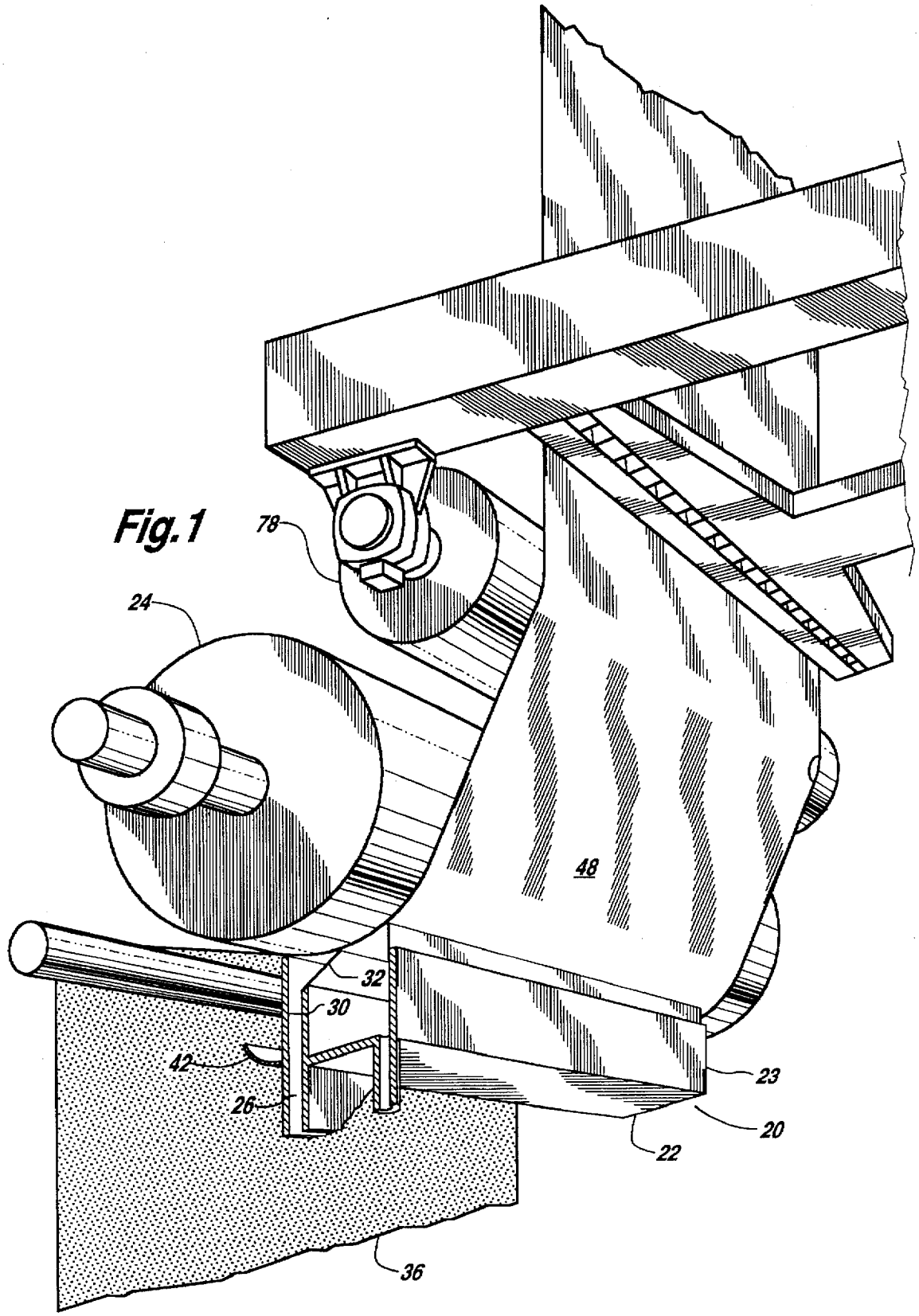
FIG. 1 is a perspective view partly cut away in section of the applicator of this invention.
Figure 2:
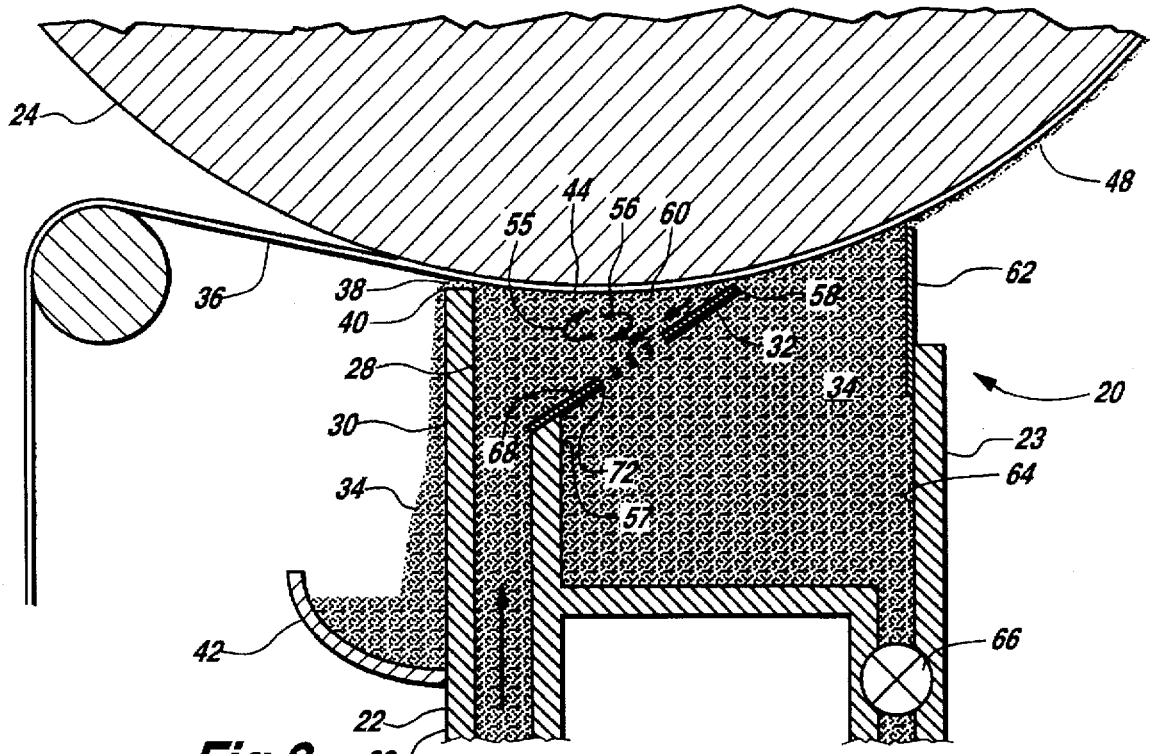
FIG. 2 is a cross-sectional elevational view of the applicator of FIG. 1.

Referring more particularly to FIGS. 1–6 wherein like numbers refer to similar parts, film applicator 20 is shown in FIGS. 1 and 2. An uncoated substrate 36 passes through the applicator 20 for application of the desired surface coating. The applicator 20 has an applicator head 22 which extends at least the width of the web and which is positioned beneath a backing roll 24. The applicator head 22 has a rigid housing 23 which extends in the cross machine direction and which has an inlet 26 through which coating is introduced to a pond 28 formed between an upstream baffle plate 30 and an angled rigid premetering plate 32.

The coating 34 is applied from the pond 28 to the substrate 36 as it passes between the backing roll 24 and the applicator head 22. A gap 38 is defined between the upper lip 40 of the baffle plate 30 and the substrate 36. The coating 34 overflows the baffle plate 30 and is allowed to escape the pond 28 through the gap 38. The gap 38, which is typically between zero and one inch and preferably between one-sixteenth and three-sixteenths of an inch high, is used to decrease the amount of air which is brought by the boundary layer of the substrate 36 into the pond 28. The overflow or flood of coating 34 which flows through the gap 38 displaces a portion of the air boundary layer. The overflow then flows into a trough 42 which is positioned upstream of the baffle plate 30. The overflowing coating 34 is collected in the trough 42 and recycled. A dynamic contact line 44 is formed where the coating 34 displaces the boundary layer.

The advantages of the film applicator 20 of this invention for applying coating fluids on lightweight and other grades of paper are its superior runnability and ease of operation for machine speeds up to forty-five hundred feet per minute or higher. As machine speeds are constantly increased, sheet quality becomes a problem as coating uniformity deteriorates. At machine speeds above thirty-five hundred feet per minute on the short dwell coater, certain formulations of coating develop low coat weight streaks and blotches, marring the appearance of the base sheet and thereby reducing the operation window within which the product may be made. Experimental data show that this uniformity problem can be attributed to a complex interplay of variables in the coating pond, including the existence of vortexes being generated in the pond, air entrained at the dynamic contact line, mixing difficulties between the low velocity incoming and high velocity recirculating coating, and flow variations from the feed in the cross-machine direction.

Figure 3:
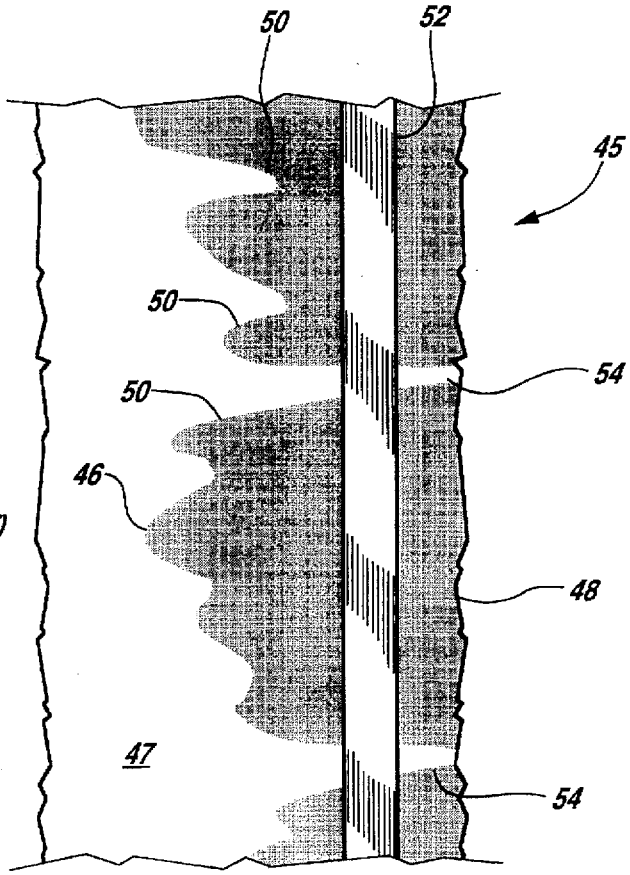
Fig.3 (PRIOR ART)
FIG. 3 is a fragmentary view of a paper web passing through a prior art coater, and the resultant coating disposition on the web.

The difficulties in achieving an even coating on the web are illustrated by the view of a prior art coater 45 shown in FIG. 3. The exemplary prior art coater has a metering blade 52 downstream of a coating pond. As the paper web 47 passes through the pond to the metering blade 52, air trapped in the boundary layer is drawn with the web. At a particular instant, the boundary layer 46 defines a dynamic contact line 46 which is wavy and unpredictable. In FIG. 3 the coated paper 48 is shown shaded and the uncoated paper web 47 is shown as unshaded. Fingers of air 50 extend into the pond toward the blade 52 and on occasion prevent coating from reaching the paper's surface forming an uncoated streak 54 on the coated paper. The applicator 20 reduces the problems associated with this unwanted air by using a low pressure region to extract air from the pond.

When run at high speeds, some prior art coaters are subject to two problems related to the boundary layer of air which is pulled into the pond. The first relates to the flow regime created by the paper web. When a papermaking machine is run at high machine speeds, that is at four-and-a-half to six thousand feet per minute, the web can induce unstable fluid flow within the pond. The unstable flow can be chaotic in nature. A chaotic system is one in which the future state of the system cannot readily be predicted from the past states of the system. In practice, it means, as shown in FIG. 3, that air fingers and streaks appear and disappear and move over time in a way that is not readily predictable. Thus it is difficult to find an applicator design which will eliminate the streaks in a chaotic environment.

A second problem caused by the interface of the rapidly moving substrate 36 and the pond 28 is that a vortex is created as shown by arrows 55 in FIG. 2. The vortex is created by the recirculation of coating within the pond caused by the rapidly flowing boundary layer of coating adjacent the moving web. This movement sets up a recirculation zone in the pond 28. The vortex can induce a region 56 of lower pressure at its center within the pond. This region of lower center 56 attracts air bubbles which have been incorporated in the recirculating pond coating by induction from the web air boundary layer. The air typically continues to accumulate in the vortex until it reaches a critical amount, at which point the accumulated air is liable to expel the coating out of the pond and collapse. This explosive breakdown of the coating flow leads to streaking and uneven coating of the paper.

The film applicator 20 of this invention solves the problem of unstable flow and air accumulation in the vortex with the premetering plate 32. The premetering plate 32 extends from the coating inlet wall 57 to an engagement point or a nip 58 adjacent to the substrate 36 and the backing roll 24. The premetering plate defines a region 60 of the pond which is narrowly tapered. The region 60 tapers in the machine direction and defines a narrow wedge of coating where the boundary layer attached to the substrate is gradually reduced. Once it has been sufficiently reduced, the flow adjacent to the substrate approaches a stable uniform flow condition. At this point, it is no longer subject to cross machines fluctuations and may be adjusted to produce a smooth coating. Between the premetering plate 32 and a final metering element 62 which can be a blade, rod (smooth or grooved), plate or roll, a low pressure cavity 64 is formed. The cavity is drained through one or more valves 66 which control the pressure in the cavity 64 which is typically maintained below the pressure next to the substrate or below atmospheric pressure if vacuum is applied.

Reduction of the vortex instability and the air entrained therein is achieved by creation of a region of low pressure along the inside surface 68 of the premetering plate 32. Low pressure on the surface 68 is produced by holes 72 in the premetering plate 32 which are connected with the low pressure cavity 64. The holes 72 preferably have a random or pseudo-random pattern concentrated in the middle one-third of the plate 32. The holes 72 serve two functions. By partially or completely removing the recirculating flow along the inside 68 of the premetering plate 32, the severity of the vortex is considerably reduced or eliminated. Secondly, by creating regions of low pressure on the inside of the premetering plate, the air is drawn from the vortex and from the coating generally to the low pressure regions adjacent to the inside 68 of the premetering plate 32, where the air is then drawn along with coating through the holes into the low pressure cavity 64.

In operation, the substrate 36, shown in FIG. 1, is brought into engagement with the backing roll 24 and thence through the flooded gap 38 into the pond 28. As the substrate approaches the premetering plate nip 58, a condition approaching a stable uniform flow regime is established and a relatively thick coating is applied to the substrate. The heavily coated substrate then proceeds past the nip 58 into the low pressure region where all fluid dynamic forces are removed from the coating. The heavily coated substrate then approaches and passes over the metering blade 62 where the majority, typically ninety percent, of the coating is scraped away leaving a uniform layer of coating on the substrate 36. The coated substrate 36 then leaves the backing roll 24 and passes over a turning roll 78 and enters a dryer section (not shown).

The paper coating is typically comprised of a plate-like filling material such as clay or calcium carbonate; a whitening agent, typically titanium dioxide; and a binder such as casein hide glue or a synthetic glue. The coating is typically applied in a slurry containing forty to seventy percent dry weight of coating materials. It should be understood, however, that the applicator 20 can be employed with coatings of various viscosity and dry solid content depending on the type of substrate being coated and the thickness of the coating being formed.

It should be understood that although the holes in the premetering plate are shown and described as being distributed in the middle third of the plate, they could be located across the entire plate or in various selected regions. Further it should be understood that the holes could be eliminated altogether and that the tapered region formed by the premetering plate and the low pressure cavity can form an improved coating on the substrate without the employment of the premetering plate with holes.

It should be understood that by feeding the coating into the pond 28 along the baffle plate 30 so that the coating enters the back of the pond cavity, the amount of air entrained into the coating is reduced. Air and excess coating which enters into the application zone defined by the tapered region 60 are removed by the holes in the premetering plate into the low pressure cavity. The removal of the circulating flow prevents instabilities from propagating into the application zone, eliminating the mixing problems between the coating entering the inlet 26 and the recirculating coating in the pond. The reduction of the macroscopic scale fluctuation variations results in a substrate with a more even coat.

Figure 4:
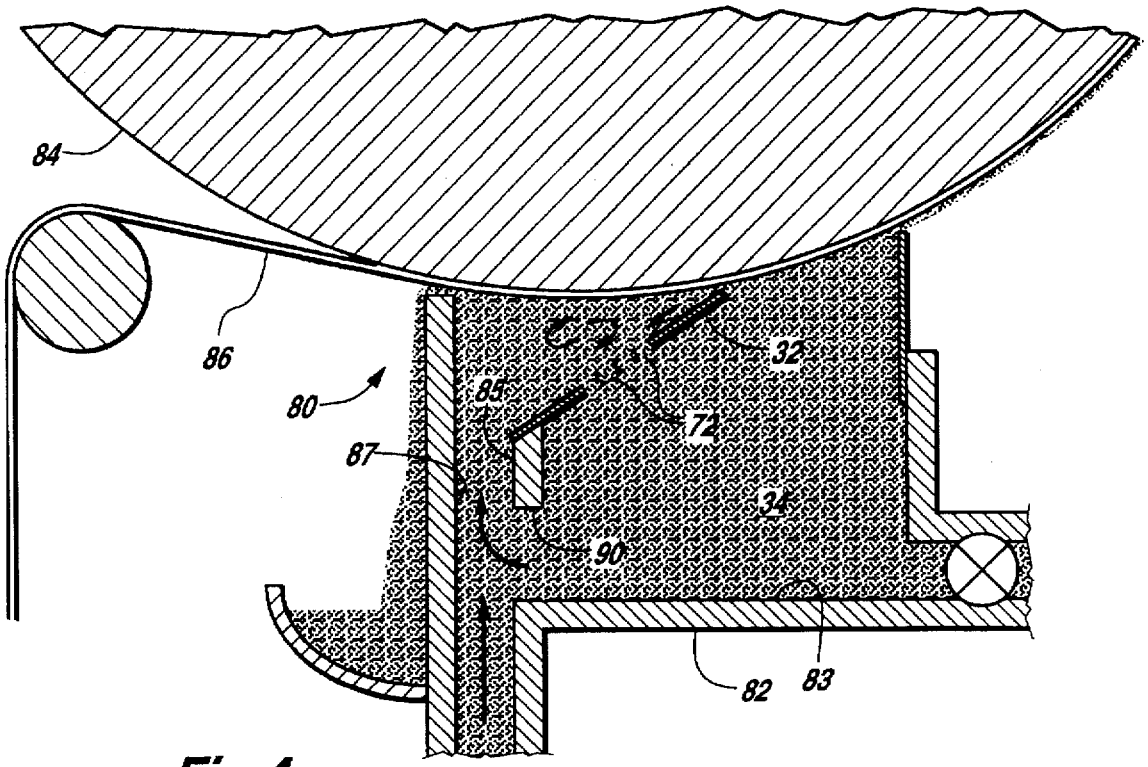
FIG. 4 is a cross-sectional view of an alternative embodiment applicator of this invention having recirculation openings.
Figure 5:
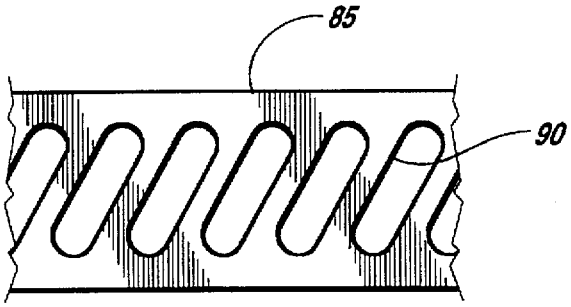
FIG. 5 is a fragmentary elevational view of the recirculation opening pattern in the applicator of FIG. 4.
Figure 6:
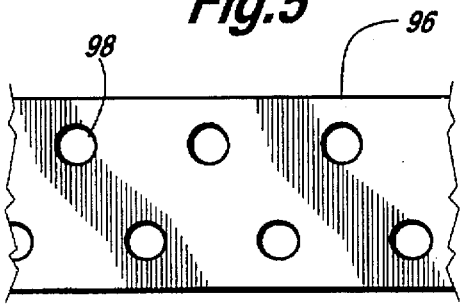
FIG. 6 is a fragmentary elevational view of the recirculation opening patern of an alternative embodiment applicator of this invention.

An alternative embodiment applicator 80 is shown in FIGS. 4 and 5. The applicator 80 is similar to the applicator 20, but is provided with an array of holes 90 in a wall 85 which defines the infeed channel 87 with respect to the housing 82. The coater 80 is positioned to apply coating material 34 to a web 86 which passes over a backing roll 84. The holes 90 allow a portion of the metered coating 34 to be recirculated by allowing access to the feed channel from the coating chamber 83. This recirculation of coating allows a reduction in pump rate requirements. The openings or perforations 90 may be an array of elongated slots which overlap as shown in FIG. 5. The slots are overlapped to ensure equal open area in a given cross-machine orientation. The overlapping of the slots can result in 0 to 20 percent more open area than an alternative hole pattern of simple circular openings 98 in a recirculation channel wall 96 shown in FIG. 6. Other hole patterns may also be employed. It should be noted that the applicator 80 may also be employed in a size press.

It is understood that the invention is not limited to the particular construction and arrangement of parts herein illustrated and described, but embraces such modified forms thereof as come within the scope of the following claims.

We claim:

1. A film applicator apparatus for applying coating material to a substrate, the apparatus comprising:

an applicator head housing disposed in close proximity to a backing roll, wherein the housing defines an application chamber which opens toward the substrate and which extends along the substrate in a cross-machine direction, and wherein the application chamber receives and retains coating material in a coating pond, and wherein the application chamber is connected to a pressurized source of coating material;

portions of the applicator head housing which define a baffle plate upstream of the application chamber, wherein the baffle plate has portions defining a lip spaced from the backing roll, and wherein excess coating material within the application chamber overflows the baffle plate lip to escape the application chamber;

a premetering plate mounted to the applicator housing downstream of the baffle plate which closely approaches the substrate against the backing roll, wherein the premetering plate extends toward the substrate at an angle of 0° to 15° to define a wedge-shaped region of the application chamber, and wherein coating is applied by the premetering plate to the substrate;

a metering element mounted to the applicator housing downstream of the premetering plate, wherein a low pressure cavity is defined between the premetering plate and the metering element and bounded by the backing roll, wherein coating and air is drawn out of the low pressure cavity, and wherein the desired level of coating on the element is achieved by the metering element;

a source of vacuum connected to the low pressure cavity.; and a means for controlling the amount of vacuum applied to the low pressure cavity.

2. The apparatus of claim 1 wherein portions of the premetering plate define holes which extend through the premetering plate establishing a connection between the application chamber and the low pressure cavity, and wherein said holes establish a low pressure region adjacent to the premetering plate which draws excess coating and air out of the coating pond within the application chamber.

3. The apparatus of claim 2 wherein the premetering plate is divided into three approximately equal width portions in the machine direction and the holes are preferably located in the central of said three portions.

4. The apparatus of claim 1 wherein the means for controlling the amount of vacuum applied is a valve connecting the source of vacuum to the low pressure cavity, wherein the valve controls the amount of vacuum applied.

5. An applicator for applying coating material to a substrate, the applicator comprising:

an applicator head housing positioned beneath a backing roll for application of coating to a substrate, and wherein the housing defines an application chamber which opens toward the backing roll and which extends along the backing roll in a cross-machine direction, and wherein the application chamber receives and retains mating material in a coating pond;

a baffle plate extending toward the backing roll;

a premetering plate mounted within the coater housing, downstream of the baffle plate, wherein the premetering plate extends toward the backing roll to define a wedge-shaped region of the application chamber, and wherein coating is applied by the premetering plate;

a metering element mounted to the applicator housing downstream of the premetering plate, wherein a low pressure cavity is defined between the premetering plate and the metering element, and bounded by the backing roll, and wherein the desired level of coating applied is achieved by the metering element; and portions of the premetering plate which define a plurality of holes extending through the premetering plate, such that coating and air within the application chamber is drawn through the holes into the low pressure cavity;

at least one valve connecting the low pressure cavity to a source of vacuum or to the atmosphere, wherein the valve controls the amount of pressure differential applied.

6. The apparatus of claim 5 wherein the low pressure cavity can be totally filled with coating material when the distance between the premetering plate and the metering element is in the range of ¼" to 2", or partially filled when the distance exceeds this range.

7. An applicator for applying coating material to a substrate, the applicator comprising:

an applicator head housing positioned beneath a backing roll for application of coating, to a substrate, and wherein the housing defines an application chamber which opens toward the backing roll and which extends along the backing roll in a cross-machine direction, and wherein the application chamber receives and retains coating material in a coating pond;

a baffle plate extending toward the backing roll;

a premetering plate mounted within the coater housing, downstream of the baffle plate, wherein the premetering plate extends toward the backing roll to define a wedge-shaped region of the application chamber, and wherein coating is applied by the premetering plate;

a metering element mounted to the applicator housing downstream of the premetering plate, wherein a low pressure cavity is defined between the premetering plate and the metering element, and bounded by the backing roll and wherein the desired level of coating applied is achieved by the metering element; and portions of the premetering plate which define a plurality of holes extending through the premetering plate, such that coating and air within the application chamber is drawn through the holes into the low pressure cavity;

an infeed channel wall which is spaced from the housing to define an infeed channel through which coating is supplied to the coating pond; and portions of the infeed channel wall which define a plurality of openings through which coating is recirculated from the low pressure cavity into the infeed channel.

8. The apparatus of claim 7 wherein the portions of the infeed channel wall which define a plurality of openings define a plurality of rows of offset holes.

9. The apparatus of claim 7 wherein the portions of the infeed channel wall which define a plurality of openings define a plurality of elongated slots which overlap, one above the other, such that equal open area in a given cross-machine orientation is defined.

10. The apparatus of claim 1 wherein the metering element comprises a blade.

11. The apparatus of claim 1 wherein the metering element comprises a smooth rod.

12. The apparatus of claim 1 wherein the metering element comprises a grooved rod.

13. The apparatus of claim 1 wherein the metering element comprises a plate.

14. The apparatus of claim 1 wherein the metering element comprises a roll.

* * * * *